United States Patent [19]

Koziol

[11] Patent Number: 4,695,355

[45] Date of Patent: Sep. 22, 1987

[54] ELECTRODE FOR MEMBRANE ELECTROLYSIS

[75] Inventor: Konrad Koziol, Röthenbach a.d.Pegnitz, Fed. Rep. of Germany

[73] Assignee: Conradty GmbH & Co. Metallelektroden KG, Rothenbach a.d. Pegnitz, Fed. Rep. of Germany

[21] Appl. No.: 862,818

[22] Filed: May 13, 1986

[30] Foreign Application Priority Data

May 31, 1985 [DE] Fed. Rep. of Germany ..... 3519573

[51] Int. Cl.[4] ..... C25B 11/02

[52] U.S. Cl. ..... 204/252; 204/282; 204/288; 204/289; 204/290 R

[58] Field of Search ..... 204/252, 282, 288, 289, 204/290 R

[56] References Cited

U.S. PATENT DOCUMENTS 4,149,956 4/1979 Bess, Sr. et al. ..... 204/289
4,264,426 4/1981 Kuusinen et al. ..... 204/289

FOREIGN PATENT DOCUMENTS 1034605 7/1978 Fed. Rep. of Germany ..... 204/256

*Primary Examiner*—John F. Niebling
*Assistant Examiner*—Terryence Chapman
*Attorney, Agent, or Firm*—Wolf, Greenfield & Sacks

[57] ABSTRACT

An electrode for membrane electrolysis comprises an electrode body, whose surface is provided at least partially with an electro-catalytically active coating.

The electrode body is constructed from a plurality of parallel, mutually spaced lamellas having a plurality of recesses on edge surfaces facing the membrane, edge surfaces of bridge portions, located between these recesses, not being coated for electro-catalytic activity.

33 Claims, 5 Drawing Figures

ELECTRODE FOR MEMBRANE ELECTROLYSIS

The invention relates to an electrode for membrane electrolysis in electrolysis cells which are preferably vertical, comprising an electrode body whose surface is provided at least partially with an electrocatalytically active coating.

Such coated electrodes are particularly employed as anodes in electrolysis devices operating according to the membrane cell method. In membrane cell technology, an ion-exchange membrane is arranged between cathode and anode. Although this membrane is impermeable to liquids, certain ions can diffuse therethrough. The membrane method for producing chlorine, sodium and potasium hydroxide and hydrogen is assuming ever more significance. Favourable technical characteristics over a widened spectrum of differing ion exchange membranes and of coating types optimized for various anode processes have meanwhile opened to the environmentally friendly membrane technology many further fields of application, such as, for example, desalination of sea water, brackish water and waste water by dialysis, reclaiming of materials from polluted industrial waste and sewage, purification of sewage or waste water and toxic solutions, sodium sulphate electrolysis for reclaiming caustic soda and sulphuric acid, sulphate electrolysis for sulphur dioxide recovery from flue gases, electro-chemical Redox processes for various organic and inorganic substances, and dimerization of organic substances.

As compared with conventional mercury cells or electrolysis cells having asbestos diaphragms, the use of membranes in electrolysis cells offers great advantages, particularly as concerns safeguarding the environment. In spite of this, there is still a series of technical and economic problems to be solved. The membrane is a complicated and very sensitive structure. Its manufacture is therefore expensive, and it must be handled particularly carefully. Membrane cell technology requires for this reason comparatively high investment costs; these must be offset by correspondingly low operational costs in order to achieve a satisfactorily economic method. Having regard to rapidly increasing electricity prices, effort should be made to reduce the energy consumption of the individual electrolysis cells as far as possible. In this context, the increase of the current density existing in the electrolysis cells, and the reduction of the voltage coefficient (so-called k factor) characterizing the cell structure, are of primary importance.

Membrane systems in particular have a pronounced dependency of specific energy consumption upon current density. Although it is possible to operate diaphragm cells, which are relatively cheap to manufacture, with relatively low current densities in the range of 2–3 $kA/m^2$, having regard to their high k value of 0.37 to 0.50 $Vm^2/kA$, the expensive membrane cells require in contrast substantially higher current densities. In order to enable economic operation, it is necessary to strive for current densities of 3 to 6 $kA/m^2$, and possibly as high as 10 $kA/m^2$.

However, the use of a membrane as separator between the electrodes impedes the use of high current densities. But it is not only the energy loss in the membrane which is a poblem. Not only the voltage drop in the membrane contributes to the high voltage coefficients k of the high-load membrane cells, which at 0.35 to 0.55 $Vm^2/kA$ are 4 to 7 times higher than those of the mercury cells, but also the following factors; these include:

- the vertical arrangement of gas-evolving electrodes on both sides of the membrane, which increases the voltage raising gas bubble effect;
- the current distribution between the electrodes, strongly impaired by the membrane, which practically comes up to a reduction of conductor cross-section of the space intermediate the electrodes;
- the adhesion of hydrogen bubbles on the membrane surface, which increases the voltage drop;
- the formation of a salt-depleted boundary layer on the anode side of the membrane, which leads to high voltage drops in current overloaded zones with insufficient $Na+$ −ion supply from the electrolyte. This local polarization moreover effects reduction of the current efficiency; and
- partial narrowing and widening of the electrode gap, caused by deviation of the anode, cathode, membrane and the seal from flatness, gives rise to irregularaties in the electrolysing process and to energy losses.

The ennumerated problems primarily obstructing increase of the current density previously prevented rapid introduction of environmentally-friendly membrane cell technology. Since however the shape, dimensions and construction of the membrane are substantially already established, the structure of the electrodes plays prominent role in further development of the membrane cell method.

The basic construction of a membrane electrolysis cell is, for exmaple, described in European patent application EP-A-01 21 608. Two flat areal electrodes, between which the membrane is securely stretched, are used as anode and cathode, respectively. In this arrangement it is, however, difficult to ensure a constant spacing from the electrodes over the entire membrane surface. In order to even out tolerances, the spacing between the membrane and the electrode, particularly the anode, must not be less than a certain minimum value. In order to use a high current density, however, the smallest possible spacing is desirable.

In DE-A-32 23 701 attempts are made to ensure exact surface parallelity of the electrode surfaces, and an energetically favourable small electrode spacing, by mounting one of the two electrodes for displacement by means of spring elements. The proposed arrangement requires additional constructional elements; deterioration of their spring properties or even jamming of the moveable parts can easily lead to failure of the electrolysis cell.

In the electrolysis cell according to DE-A-31 32 947, the membrane is resiliently pressed by means of a special support construction onto one of the flat electrodes. It is true that by this means the spacing between the membrane and electrodes approaches zero, but one side of the membrane is, however, completely covered by the superimposed electrode. The membrane is thus only in contact with the electrolyte on one side; supply of ions from the electrolyte is therefore impeded. Furthermore, the resulting gas bubbles can escape only on one side. The additional support construction renders the electrolysis cell considerably more expensive. Furthermore, special provision must be made to ensure that the sensitive membrane is not damaged by the resilient elements of the support construction.

The bipolar electrolysis cell described in German Pat. No. 25 45 339 also has an areal electrode adjoined by the membrane at zero spacing. The poor gas discharge caused by this is allegedly improved by intermediate chambers or openings in the electrode. Particularly the upward escape of gas bubbles is considerably obstructed by such a flat electrode with superimposed membrane. Moreover, here also large parts of the membrane are excluded from supply of electrolyte.

Finally, in European patent application EP-A-00 95 039, a electrode with a grid-like construction is proposed. The membrane is stretched between the grid bars of respective pairs of electrodes. This has the consequence that the thin membrane adopts a wave shape between the electrodes, which leads to completely inhomogonous current density distribution. As a result of the mounting of the membrane, both on the anode and also on the cathode, in this case also relatively large parts of the membrane fail to make contact with the electrolyte. It is true that gas bubbles can escape on both sides of the membrane, but the substantially horizontal arrangement of the grid elements obstructs free gas discharge from the cells. The voltage coefficient of such membrane electrolysis cells is unsatisfactory.

Likewise, in European patent application EP-A-00 79 445, an electrode which is in principle laminar is proposed. Special protrusions or hollows bent out of the surface are intended to reduce the current requirements of this electrode. This electrode is electro-catalytically coated over its entire surface. A superimposed ion-exchange membrane would, for this reason, be damaged on the contact surfaces as a result of the current peaks which there appear, if one wished to realise the high current density mentioned in the introduction with such an electrode. Again, a high proportion of the surface of the membrane facing the electrode is covered, which leads to insufficient supply of electrolyte. Since the very thin flat membrane lies on arcuate surfaces, excessively high localised mechanical loading occurs, which brings the danger of damage to the sensitive and expensive membrane. Moreover, gas bubbles can easily become lodged in the round cavities, which can critically effect current transport to the electrode. This electrode is therefore quite unsuitable for constructing a membrane electrolysis cell with a good voltage coefficient, which can be driven with high current densities.

The multiplicity of previously known and extremely varied forms of electrodes for membrane electrolysis makes clear the difficulties of finding an optimum electrode construction.

An object of the invention is therefore to create an electrode, which, whilst avoiding the described disadvantages, is suitable for the construction of a membrane electrolysis cell having good voltage coefficients which can be driven at high current densities, and which, moreover, permits simple and therefore inexpensive manufacture.

This object is achieved with an electrode for membrane electrolysis comprising an electrode body, whose surface is provided at least partially with an electrocatalytically active coating, in that the electrode body is constructed from a plurality of parallel, mutually spaced lamellas, in that the lamellas have a plurality of recesses on their edge surfaces facing the membrane, and in that the edge surfaces of the bridge portions located between these recesses are not coated for electro-catalytic activity.

The electrode constructed according to the invention is exceptionally suitable for mounting an ion-exchange membrane. Thus, the membrane lies flat on the edge surfaces of the bridge portions located between the recesses, so that the effective spacing between the membrane and the electrode is zero. This permits the construction of a so-called "zero gap cell". Since the edge surfaces of the bridge portions, on which the membrane lies, are uncoated, no current peaks can occur there. Overloading of the membrane as a result of this is thus substantially excluded. The membrane contacts the electrode over its entire surface. In contrast to rigid tensioning of the membrane, this permits unobstructed working of the separator, for example when the electrolyte level in the cell is too low.

A substantial further advantage, as compared with conventional electrodes, consists in that the membrane is substantially freely supported in the cell chamber, and is covered only slightly by the bridge portions of the electrode body. It therefore receives an excellent supply of electrolyte from all sides, so that the necessary supply of ions is ensured. Local polarization effects, which can damage the membrane, are thus prevented. Loss of electro-catalytically active electrode surface by the uncoated edge surfaces of the bridge portions is low, so that with the electrode according to the invention high current densities can nevertheless be achieved.

The proposed lamellar structure of the electrode in conjunction with the plurality of recesses on the edge surfaces facing the membrane, enables, moreover, a rapid escape of gas bubbles.

The proposed electrode geometry thus permits the construction of high-quality membrane electrolysis cells with desired low voltage coefficient.

A vertical arrangement of lamellas in the vertical cells feeds the flow of electrolyte through the cell upwardly from below. A vertical cell structure is also of advantage in respect of the gas bubble effect, which opposes high current densities.

The lamellas forming the electrode body are expediently constructed as rectangular flat plates. Such plates can be manufactured easily; moreover, the recesses according to the invention can be easily provided.

In a preferred embodiment of the invention, the recesses in two neighbouring lamellas are mutually offset. This permits particularly uniform support of the superimposed membrane.

Expediently, the recesses of all the lamellas have the same dimensions, and are regularly arranged. By this means, particularly uniform current density distribution is achieved.

Particularly uniform mechanical and electrical loading of the superimposed membrane is achieved when the recesses of the two neighbouring lamellas are mutually offset by half the width of a recess.

A flat construction of the edge surfaces of the bridge portions permits flat superimposition of the membrane. This can then be easily displaced relative to the electrode, for example in the event of length changes by the absorption of liquid, or as a result of temperature changes. Lamellas with flat edge surfaces can be manufactured particularly easily and economically. Passivation of the bridge portion surfaces can thus be effected by simple abrasion of the electro-catalytically active coating by means of an abraiding machine.

Rectangular recesses can be produced in the lamellas particularly easily. Moreover, the bases of such recesses lie parallel to the membrane, and thus also to the current direction. This leads to the largest possible effective electro-catalytically active surface of the electrode according to the invention. However, also other shapes of the recesses, for example, round shapes, are conceivable.

To prevent current peaks, the edges between the bases and the lateral surfaces of the recesses and the edges between the recesses and the edge surfaces of the bridge portions can be rounded. Likewise, the edges between the edge surfaces of the bridge portions and the lateral surfaces of the lamellas can be rounded off.

In the preferred embodiment of the electrode according to the invention, the width of the recesses is approximately equal to the width of the bridge portions. This dimensioning represents a good compromise between the requirement for the best possible support of the membrane and simultaneous substantially unimpeded supply of electrolyte.

It is regarded as particularly advantageous when the dimensions are such that the depth of the recesses is less than their width, and the spacing between two neighbouring lamellas is approximately equal to the width of the recesses. In this connection, the width of the recesses and the width of the bridge portions are each of the order of a few millimeters.

Particularly high current densities can be achieved where the width of the recesses and of the bridge portions are in each case between 3 and 10 mm, preferably 5 mm.

A depth of the recesses of a few millimeters suffices for sufficient supply of the membrane with electrolyte. Particularly good results are achieved with recesses whose depth lies between 2 and 4 mm.

Sufficient electrolyte flow between the lamellas occurs with a lamallar spacing of a few millimeters; in a particularly preferred embodiment, this spacing amounts to between 4 and 6 mm.

In an expedient embodiment of the invention, the lamellas are electrically conductively interconnected by means of a current distributor. Substantially unimpeded electrolyte flow is achieved in an arrangement having a rectangular current distributor on the rear side of the lamellas.

Electrolysis cells having electrode bodies of valve metal, preferably titanium, are distinguised by a particularly high current efficiency.

An exemplary embodiment of the invention will be described in the following, with reference to the accompanying drawings, in which:

Figure 1:
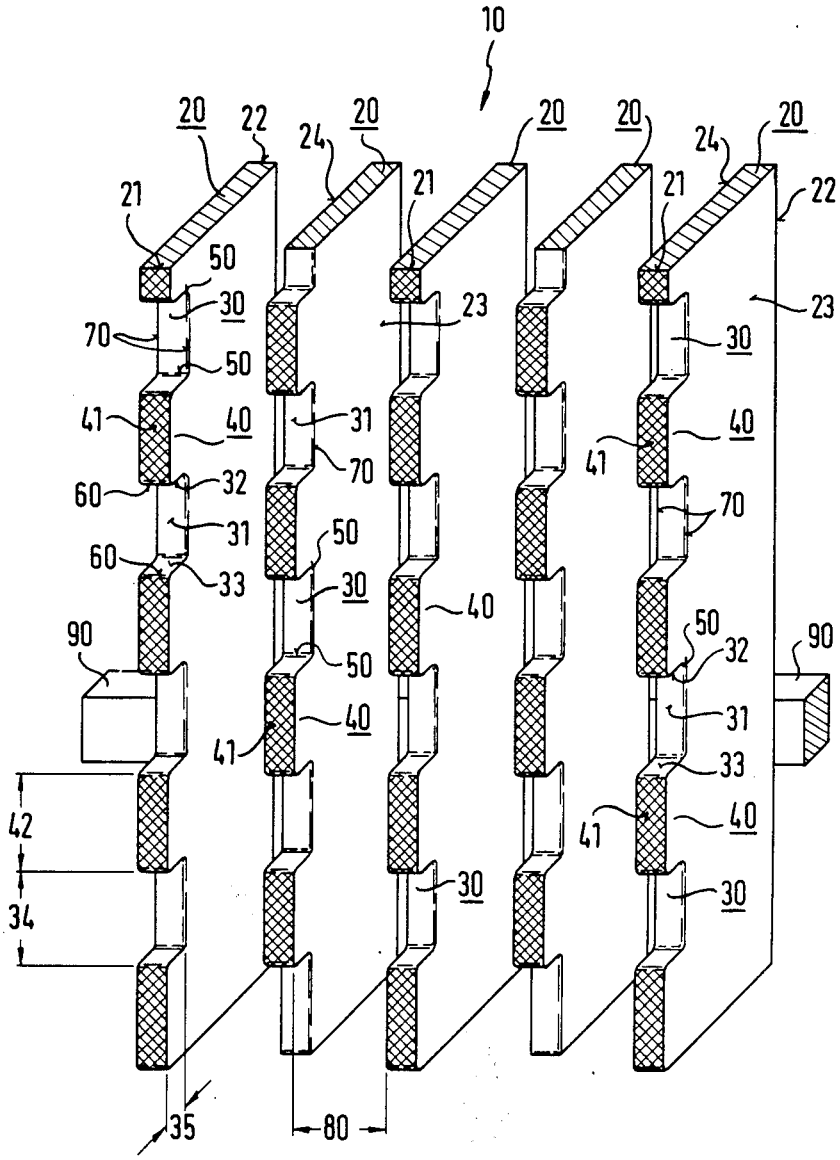
FIG. 1 shows a detail of an electrode according to the invention, having perpendicularly arranged lamellas, constructed as rectangular flat plates with offset recesses of rectangular cross-section, in a simplified perspective view.

The electrode illustrated in FIG. 1 comprises an electrode body 10, having a plurality of perpendicularly standing parallel, mutually spaced lamellas 20. These lamellas 20 are constructed as rectangular flat plates. On their edge surfaces 21 they have a plurality of similar recesses 30 of retangular cross-section. Between the recesses 30 are located bridge portions 40, having flat edge surfaces 41. The lamellas 20 forming the electrode body 10 are made of titanium. With the exception of the edge surfaces 41, the lamellas 20 are provided with an electro-catalytically active coating. The edges 50 between the base surfaces 31 and the side surfaces 32, 33 of the recesses 30 are rounded. Likewise, the edges 60 between the recesses 30 and the edge surfaces 41 and the edges 70 between the edge surfaces 41 and the side surfaces 23, 24 of the lamellas 20 are rounded off. The width 34 of the recesses 30 is equal to the width 42 of the bridge portions 40. The depth 35 of the recesses 30 is less than their width 34; it amounts to approximately 3 mm. The recesses 30 of all lamellas 20 are regularly arranged. The recesses 30 of two neighbouring lamellas 20 are mutually offset exactly by half the width 34.

All lamellas 20 are mutually spaced by the same spacing 80. The spacing 80 amounts to approximately 5 mm. On their rear sides 22, the lamellas are electrically conductively interconnected by means of a current distributor 90 of rectangular cross-section.

Figure 2:
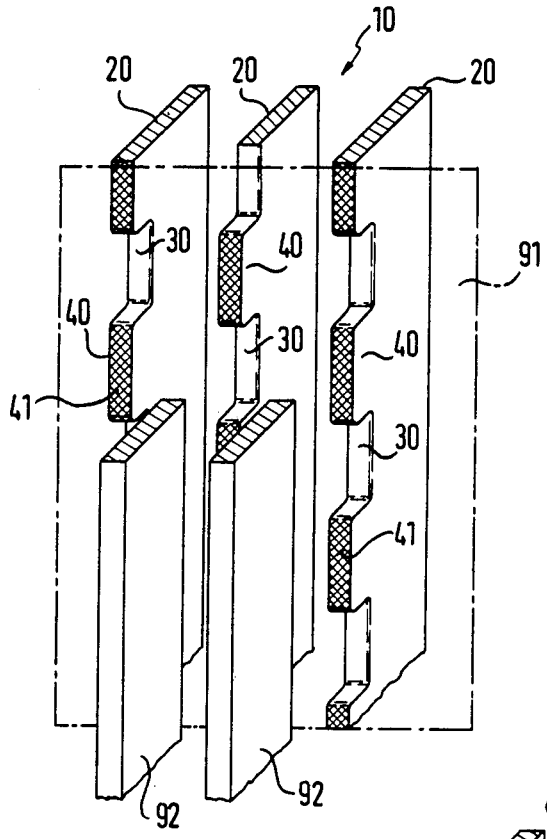
FIG. 2 shows a detail of a membrane electrolysis cell, having the electrode according to FIG. 1 as anode, a superimposed ion-exchange membrane, and a lamellar cathode as counter-electrode, in a schematic perspective view.

FIG. 2 schematically illustrates a construction of a membrane electrolysis cell employing the described electrode according to the invention of FIG. 1. The lamellas 20 stand vertically in the cell and form the anode. On the end surfaces 41 of the bridge portions 40, is supported a membrane 91. A counter-electrode 92 is constructed as a lamellar cathode. The spacing between the membrane 91 and the counter-electrode 92 amounts to a few mm.

Figure 3:
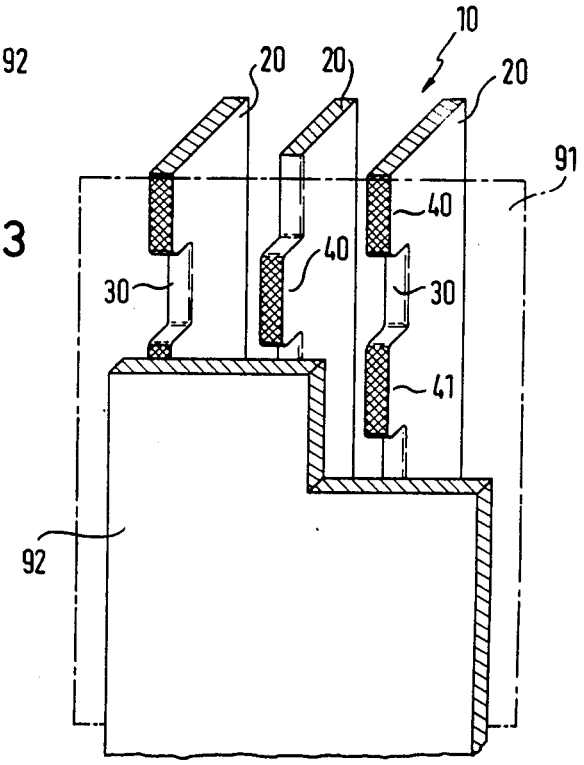
FIG. 3 shows a detail of a membrane electrolysis cell according to FIG. 2, having a solid sheet cathode as counter-electrode.

FIG. 3 shows a similar arrangement in which the electrode according to the invention opposes a solid-sheet cathode forming a counter-electrode 92.

Figure 4:
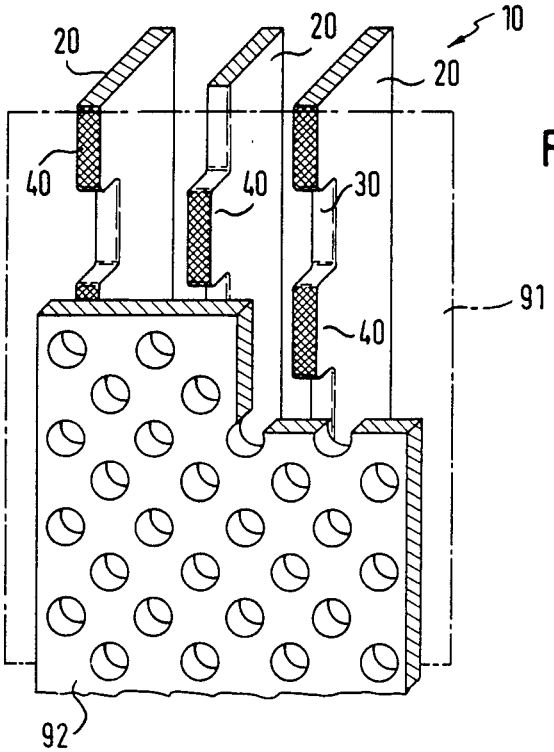
FIG. 4 shows a detail of a membrane electrolysis cell according to FIG. 2, having an apertured sheet cathode as counter-electrode.

In the membrane electrolysis cell illustrated in FIG. 4, a counter-electrode 92 is formed by an apertured sheet cathode. This contruction is distinguished by a particularly favourable current distribution and a good supply to the membrane 91. On the anode side, the liquid electrolyte can pass unimpeded to the membrane 91 through the intermediate chamber between the lamellas 20 and their recesses 30. On the cathode side, electrolyte supply takes place through the holes in the counter-electrode 92.

Figure 5:
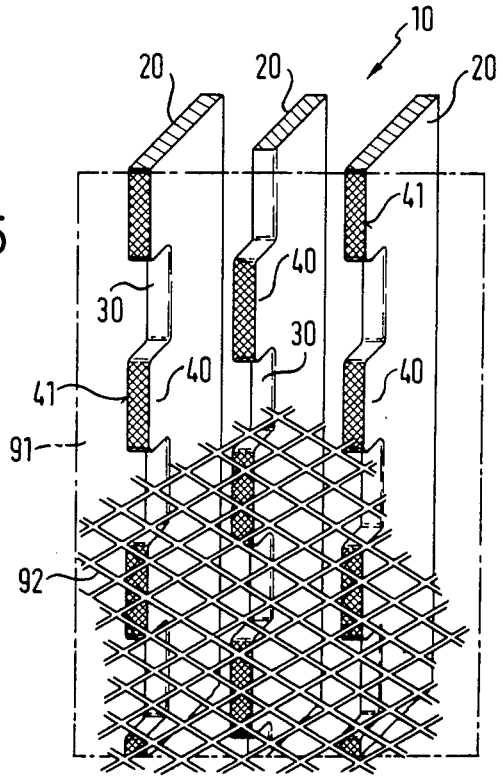
FIG. 5 shows a detail of a membrane electrolysis cell according to FIG. 2, having an expanded mesh cathode as counter-electrode.

Finally, FIG. 5 shows a membrane electrolysis cell, having an electrode according to the invention as anode, and a counter-electrode 92 constructed as an expanded mesh cathode.

The membrane 91 is substantially free in the chamber. Only about 10% of the membrane 91 is covered by the edge surfaces 41 of the bridge portions 40. In conjunction with the open structure of the counter-electrode 92, an excellent supply of $Na+$ ions is hereby achieved. The vertical structure of the electrolyte cell as a result of the perpendicular arrangement of the lamellas 20 permits unimpeded upward escape of the gas bubbles evolved.

What is claimed is:

1. An electrode for membrane electrolysis comprising an electrode body having a surface provided at least partially with an electro-catalytically active coating and being formed from a plurality of parallel, mutually spaced lamellas, each lamella having an edge surface for supporting a membrane, on which edge surface is provided a plurality of recesses separated by respective bridge portions not coated for electro-catalytic activity.

2. An electrode according to claim 1 wherein the lamellas are disposed vertically.

3. An electrode according to claim 1 wherein the lamellas are rectangular flat plates.

4. An electrode according to claim 1 wherein the recesses of two neighbouring lamellas are mutually offset.

5. An electrode according to claim 1 wherein the recesses of all lamellas have the same dimensions and are regularly arranged.

6. An electrode according to claim 5 wherein the recesses of two neighbouring lamellas are mutually offset by half the width of a recess.

7. An electrode according to claim 1 wherein the edge surfaces of the bridge portions are flat.

8. An electrode according to claim 1 wherein the recesses have rectangular cross-section.

9. An electrode according to claim 8 wherein edges separating base surfaces and side surfaces of the recesses are rounded.

10. An electrode according to claim 1 wherein edges separating the recesses and edge surfaces of the bridge portions are rounded.

11. An electrode according to claim 1 wherein edges separating edge surfaces of the bridge portions and side surfaces of the lamellas are rounded.

12. An electrode according to claim 1 wherein the width of the recesses is approximately equal to the width of the bridge portions.

13. An electrode according to claim 12 wherein the width of the recesses and the width of the bridge portions are each equal to a few millimeters.

14. An electrode according to claim 13 wherein the width of the recesses and the width of the bridge portions are each in the range of from 3 to 10 millimeters.

15. An electrode according to claim 14 wherein the width of the recesses and the width of the bridge portions are each equal to about 5 millimeters.

16. An electrode according to claim 1 wherein the depth of the recesses is smaller than the width of the recessses.

17. An electrode according to claim 16 wherein the depth of the recesses is equal to a few millimeters.

18. An electrode according to claim 17 wherein the depth of the recesses lies in the range of from 2 to 4 millimeters.

19. An electrode according to claim 1 wherein the spacing between two neighbouring lamellas is approximately equal to the width of the recesses.

20. An electrode according to claim 14 wherein the spacing between the lamellas is equal to a few millimeters.

21. An electrode according to claim 20 wherein the spacing between the lamellas is approximately in the range of from 4 to 6 millimeters.

22. An electrode according to claim 1 wherein the lamellas are electrically conductively interconnected by means of a current distributor.

23. An electrode according to claim 22 wherein the current distributor is arranged on edge surfaces of the lamellas opposite to those having said recesses.

24. An electrode according to claim 22 wherein the current distributor has rectangular cross-section.

25. An electrode according to claim 1 wherein the electrode body consists of a valve metal.

26. An electrode according to claim 25 wherein the electrode body is made of titanium.

27. An electrode according to claim 1 wherein a membrane for membrane electrolysis is supported by said edge surfaces of said bridge portions.

28. A membrane electrolysis cell comprising: a membrane; a first electrode on one side of said membrane; and a second electrode on the other side of said membrane, said first electrode comprising an electrode body having a surface provided at least partially with an electro-catalytically active coating and being formed from a plurality of parallel, mutually spaced lamellas, each lamella having an edge surface for supporting said membrane, on which edge surface is provided a plurality of recesses separated by respective bridge portions not coated for electro-catalytic activity.

29. A cell according to claim 28 wherein said first electrode is connected as an anode and the second electrode is connected as a cathode.

30. A cell according to claim 28 or 29 wherein said second electrode comprises a plurality of lamellas.

31. A cell according to claim 28 or 29 wherein said second electrode comprises a solid plate.

32. A cell according to claim 28 or 29 wherein said second electrode comprises an apertured plate.

33. A cell according to claim 28 or 29 wherein said second electrode comprises a grid member, preferably of expanded metal sheet.

* * * * *